US005234306A

United States Patent [19]

Yamashita

[11] Patent Number: 5,234,306

[45] Date of Patent: Aug. 10, 1993

[54] PANEL STORAGE FEEDER

[75] Inventor: Koichi Yamashita, Yokohama, Japan

[73] Assignee: Kabushiki Kaisha Tokyo Kikai Seisakusho, Tokyo, Japan

[21] Appl. No.: 738,229

[22] Filed: Jul. 30, 1991

[30] Foreign Application Priority Data

Dec. 21, 1990 [JP] Japan ..... 2-418129

[51] Int. Cl.[5] ..... B65B 35/30

[52] U.S. Cl. ..... 414/331; 414/222; 414/416; 414/789.9

[58] Field of Search ..... 414/222, 225, 331, 416, 414/789.9; 198/475.1, 800; 53/153, 389.1

[56] References Cited

U.S. PATENT DOCUMENTS

| | | | |
|---|---|---|---|
| 3,206,043 | 9/1965 | Kile | 414/222 X |
| 4,041,853 | 8/1977 | Verwey et al. | 414/789.9 X |
| 4,530,200 | 7/1985 | Prewer | 53/157 |
| 4,538,511 | 9/1985 | Wise | 414/789.9 X |
| 4,557,656 | 12/1985 | Ouellette | 414/789.9 X |
| 4,750,132 | 6/1988 | Pessina et al. | 414/751 |
| 4,907,941 | 3/1990 | Fock et al. | 414/416 X |
| 5,011,467 | 4/1991 | Traegaardh | 414/416 X |
| 5,013,022 | 5/1991 | Graushar | 414/331 X |
| 5,092,730 | 3/1992 | Neri | 414/331 |

FOREIGN PATENT DOCUMENTS

| | | | |
|---|---|---|---|
| 55-35297 | 9/1980 | Japan . | |
| 0145030 | 11/1981 | Japan | 414/789.9 |
| 61-136845 | 6/1986 | Japan . | |
| 1-36726 | 11/1989 | Japan . | |
| 2197299 | 5/1988 | United Kingdom | 414/331 |
| 2234740 | 2/1991 | United Kingdom | 53/389.1 |

*Primary Examiner*—Frank E. Werner
*Assistant Examiner*—James Keenan
*Attorney, Agent, or Firm*—Trexler, Bushnell, Giangiorgi & Blackstone, Ltd.

[57] ABSTRACT

A panel storage feeder consists of a signature piling space, a panel feeding mechanism, a panel group storage mechanism and a panel group transfer mechanism. The panel feeding mechanism is disposed over the signature piling space to feed panels thereto one by one. The panel group storage mechanism is disposed at the side of the signature piling space and including the upper portion thereof provided at a level substantially equal to that of the panel feeding mechanism. The panel group transfer mechanism is disposed for transferring to a panel storage unit of the panel feeding mechanism from the upper portion of the panel group storage mechanism by a pair of hands moving therebetween. Thus, the panels are continuously and smoothly fed to the signature piling space.

2 Claims, 7 Drawing Sheets

PANEL STORAGE FEEDER

BACKGROUND OF THE INVENTION

The present invention relates to a panel feeding mechanism for feeding a panel to each of the two end faces of folded signatures, when a predetermined number of folded signatures are to be collected, and, more particularly, to a panel storage feeder capable of feeding the panels for a long time by preparing a remarkably large number of panels in advance for shortage of the panel feed.

In case a pile of signatures is to be bundled with a band, several signatures positioned at the two ends of the pile may often be damaged or blotted as a result of contact, if any, with another body. In order to prevent this, there has been conventionally provided an apparatus for feeding the panels to the two end faces of the signature pile. This panel feeder is well known in the art, as disclosed in Japanese Patent Laid-Open No. 136845/1986, Japanese Utility Model Publication No. 36726/1989 or Japanese Patent Publication No. 35297/1980.

In the above-enumerated panel feeder of the prior art, the panels are fed to the two end faces of the signature pile by arranging a single or a pair of panel storage units for storing a number of panels in an inclined, horizontal or vertical position above or at the side of a signature pile treating space and by moving each of the panels sequentially to one end in the aforementioned panel storage unit, to the upper end by a lift, or to the lower end by its own weight to feed out the panels one by on from that end into the aforementioned signature pile treating space.

Since, however, any of the conventional apparatus has its panel storage unit given a small storage capacity, it frequently requires the worker to confirm the residual of the panels and supply new panels during the run of the apparatus. Especially in recent years having a high printing speed, the piling time of a predetermined number of signatures is shortened to make more frequent the confirmation of the residing panels and the supply of new panels. If the panel supply should not be in time, the naked signature pile having no panel applied thereto is bundled and conveyed out so that it is damaged or blotted, as has been described hereinbefore.

In the apparatus of the prior art, moreover, the panels have to be supplied directly to the panel storage unit during the run of the machine. As a result, the supply works not only are dangerous but also take such a long time as to drop the working efficiency.

SUMMARY OF THE INVENTION

An object of the present invention is to provide a panel storage feeder which can reduce the frequency of confirmations of the residual of panels and eliminate or reduce the supply during the run of the machine and can accomplish the panel supply continuously and smoothly, safely and efficiently.

A panel storage feeder in the present invention consists of a signature piling space, a panel feeding mechanism, a panel group storage mechanism, and a panel group transfer mechanism.

The panel feeding mechanism is disposed over the signature piling space to feed panels thereto one by one.

The panel group storage mechanism is disposed at the side of the signature piling space and including the upper portion thereof provided at a level substantially equal to that of the panel feeding mechanism.

The panel group transfer mechanism is disposed for transferring to a panel storage unit of the panel feeding mechanism from the upper portion of the panel group storage mechanism by a pair of hands moving therebetween.

Each time the panels stored in the storage unit of the panel feed mechanism are sequentially delivered one by one so that their residual becomes short, the panel groups waiting on the shelves arrayed in the panel group storage mechanism are sequentially moved to stand by in the transfer position which is the same level equal to that of the storage unit of the panel feeding mechanism so that the panel group in the standby position is transferred to the panel storage unit and is automatically supplied.

BRIEF DESCRIPTION OF THE DRAWINGS

FIG. 7 is a top plan view showing the associated operations of the transfer of a panel group and the feed of the transferred panels and the state, in which the feed of the panels from the transfer destination is ended while the subsequent panel group standing by;

DESCRIPTION OF THE PREFERRED EMBODIMENT

Figure 1:
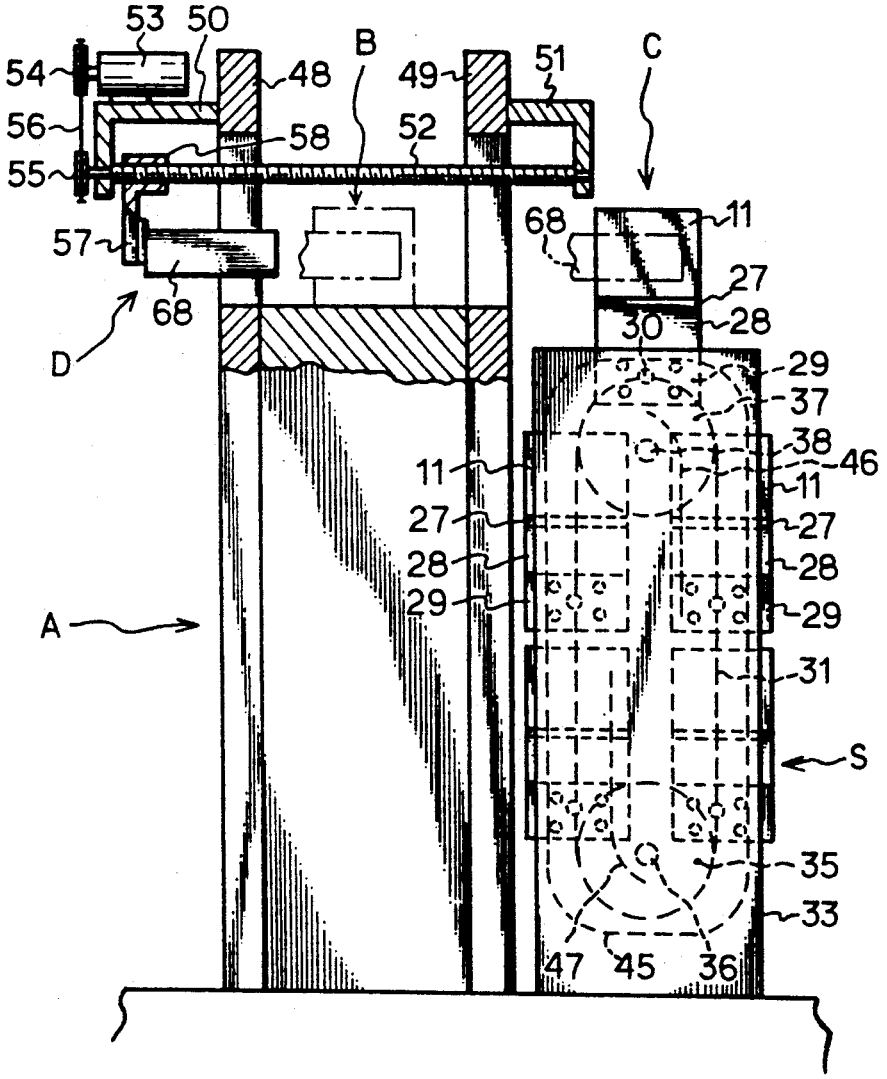
FIG. 1 is a front elevation showing a partially longitudinal section of the whole structure of a panel storage feeder according to the present invention.

As shown in FIG. 1, the panel storage feeder according to the present invention is constructed to comprise: a conventional panel feed mechanism B arranged above the conventional signature piling space such as a stacker/bundler A; a panel group storage mechanism C arranged at the side of the stacker/bundler A; and a panel group transfer mechanism D for transferring a panel group 11 from the panel group storage mechanism C to the panel feed mechanism B.

Figure 4:
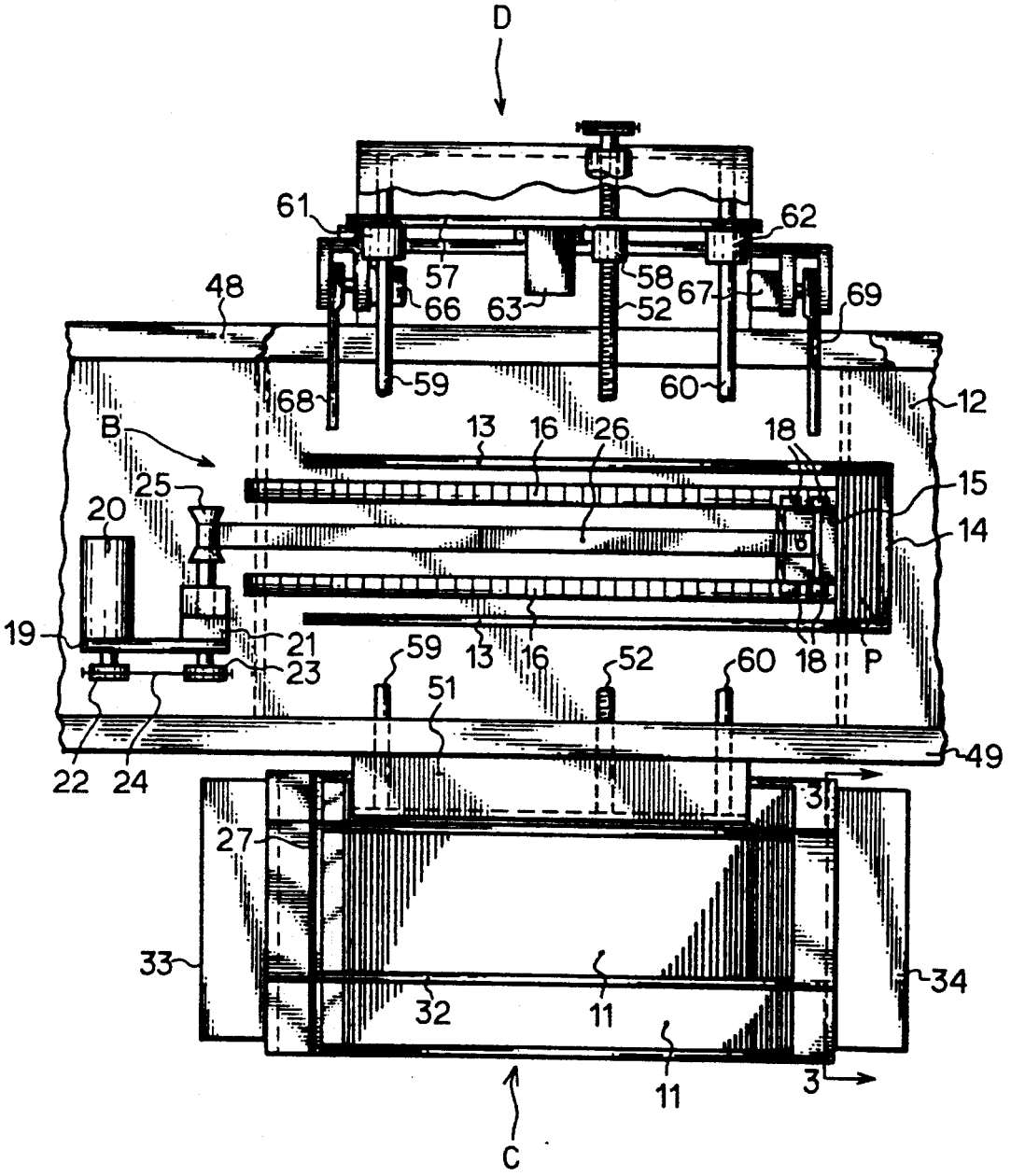
FIG. 4 is a top plan view of FIGS. 1 and 2.
Figure 6:
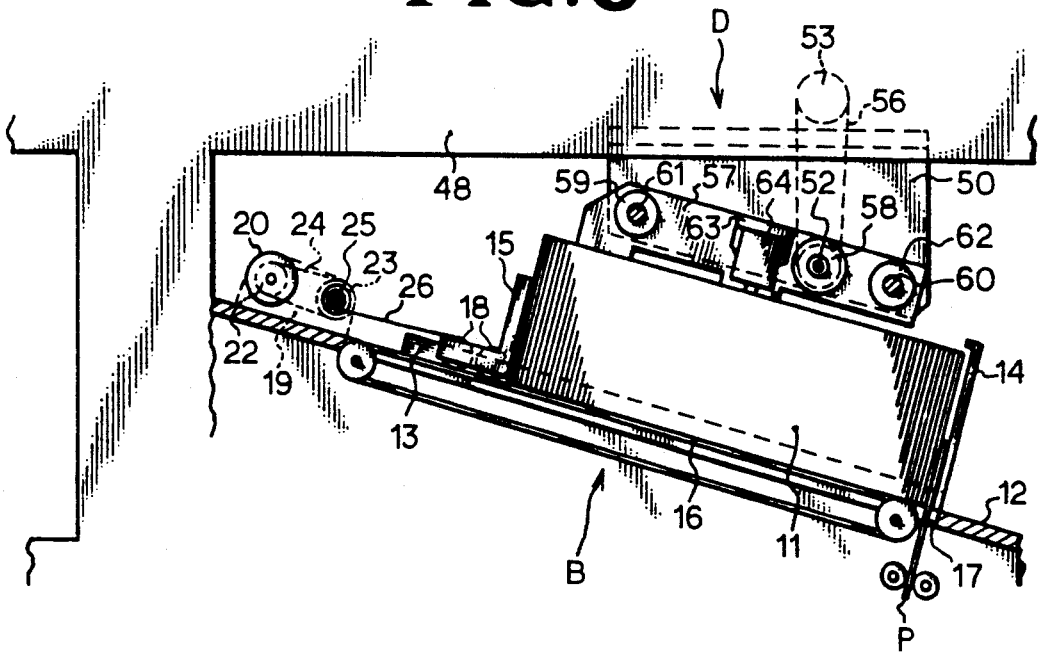
FIG. 6 is a righthand side elevation showing the central portion of FIG. 4.

First of all, the panel feed mechanism B is composed, for example, of: a panel storage unit for storing the panel group 11 or a pile of a number of panels; and panel delivery means for delivering the panels sequentially one by one in a predetermined position from the storage unit toward the aforementioned stacker/bundler A, as shown in FIGS. 1, 4 and 6.

The panel storage unit is composed of: a guide slope 12 extending generally in parallel with the bottom of the stacker/bundler A; guide walls 13 and 13 capable of having their gaps adjusted for regulating the two side faces of the panel group 11; a pawl plate 14 for supporting the front end face of the panel group 11; and a hold member 15 for supporting the rear end face of the panel group 11.

Next, the panel delivery means is composed of: panel push means for pushing the front end face of the panel group 11 onto the pawl plate 14 at all times; pawl plate drive means for delivering the foremost panel toward the stacker/bundler A; and fall preventing means for preventing the fall of the rear end of the panel group 11. At first, the panel push means is composed of a pair of endless belts 16 and 16 which are juxtaposed along the aforementioned guide slope 12 to have slightly higher upper faces than the slope. All the panels belonging to the aforementioned group 11 are arranged on those belts 16 and 16. These belts are made to run rightward of FIG. 4 by the drive means (although not shown) to push the individual panels on the belts onto the pawl plate 14 at all times. If the pawl plate drive means is then actuated to move the pawl plate 14 down by its not-shown vertical drive means, the foremost panel is hooked down by the pawl until it is delivered from an exit port 17 formed in the guide slope 12 toward the stacker/bundler A. Moreover, the means for preventing the break of the rear end of the panel group 11 is composed of rollers 18 and 18 which are so projected from the two side faces of the aforementioned hold member 15 as to turn on the aforementioned belts 16 and 16 so that the hold member 15 may slide on the belts 16 and 16 of the aforementioned slope 12 to support the rear end face of the panel group 11 thereon.

Figure 8:
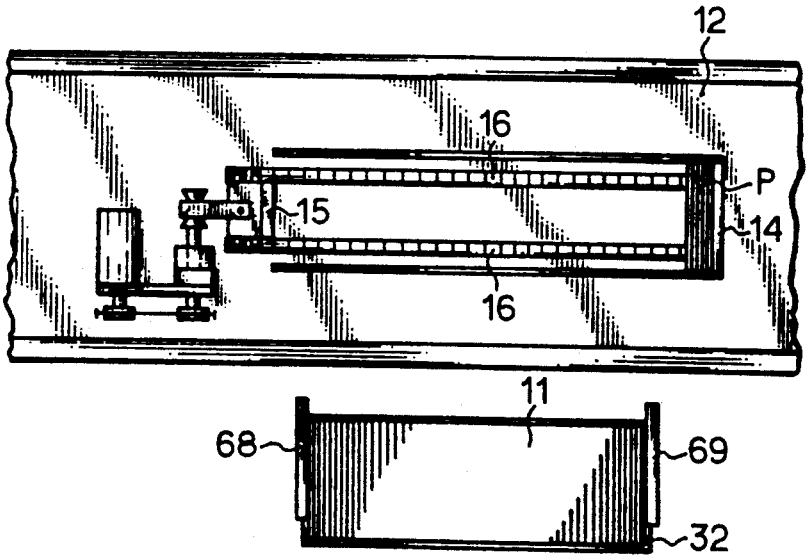
FIG. 8 is a top plan view showing the associated operations of the transfer of a panel group and the feed of the transferred panels and the state, in which the transfer of the standby panel group is started.

Incidentally, the hold member 15 is equipped with a return mechanism for returning it to an initial position. This return mechanism is constructed, as shown in FIGS. 4 and 6, by fixing a motor 20 and a clutch 21 on a bracket 19 disposed at a higher side of the guide slope 12, by connecting a sprocket 22 fixed on the output shaft of the motor 20 and a sprocket 23 fixed on the input shaft of the aforementioned clutch 21 by means of an endless chain 24, by fixing a reel 25 on the shaft end of the clutch 21, and by fixing one end of a ribbon 26 to the reel 25 and the other end to the aforementioned hold member 15. As a result, for the panel delivery period, the engagement of the clutch 21 is released, so that the hold member 15 slides by its own weight to push and support the rear end face of the panel group 11 at all times. If the delivery of the panels advances so that the residual of the panels in the storage unit reaches a predetermined number, the engagement of the clutch is restored in response to an input signal so that the rotational power is transmitted to the aforementioned reel 25 to wind up the ribbon 26. As a result, the hold member 15 is pulled up to restore its initial position (as shown in FIG. 8) against the gradient of the slope 12. This hold plate return mechanism is started for the operation of the transfer mechanism D for transferring the subsequent panel group to the panel storage unit.

Figure 2:
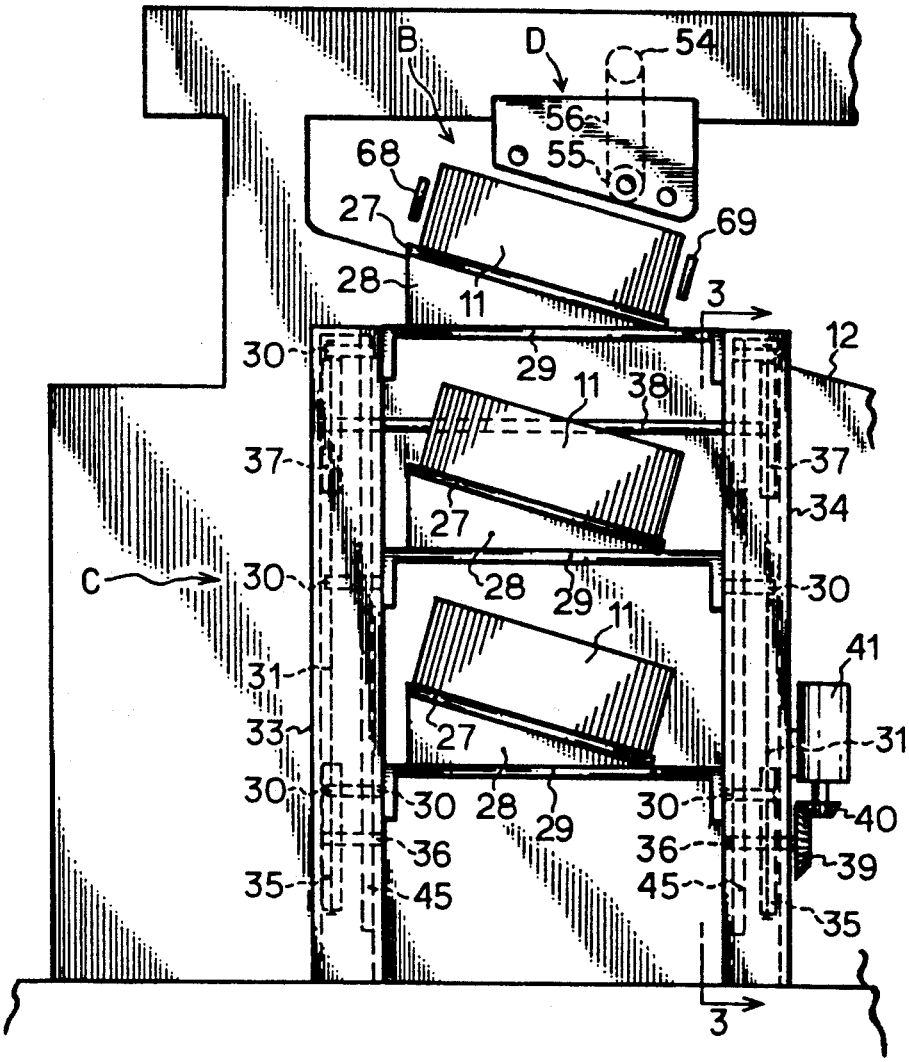
FIG. 2 is a righthand side elevation of FIG. 1.
Figure 3:
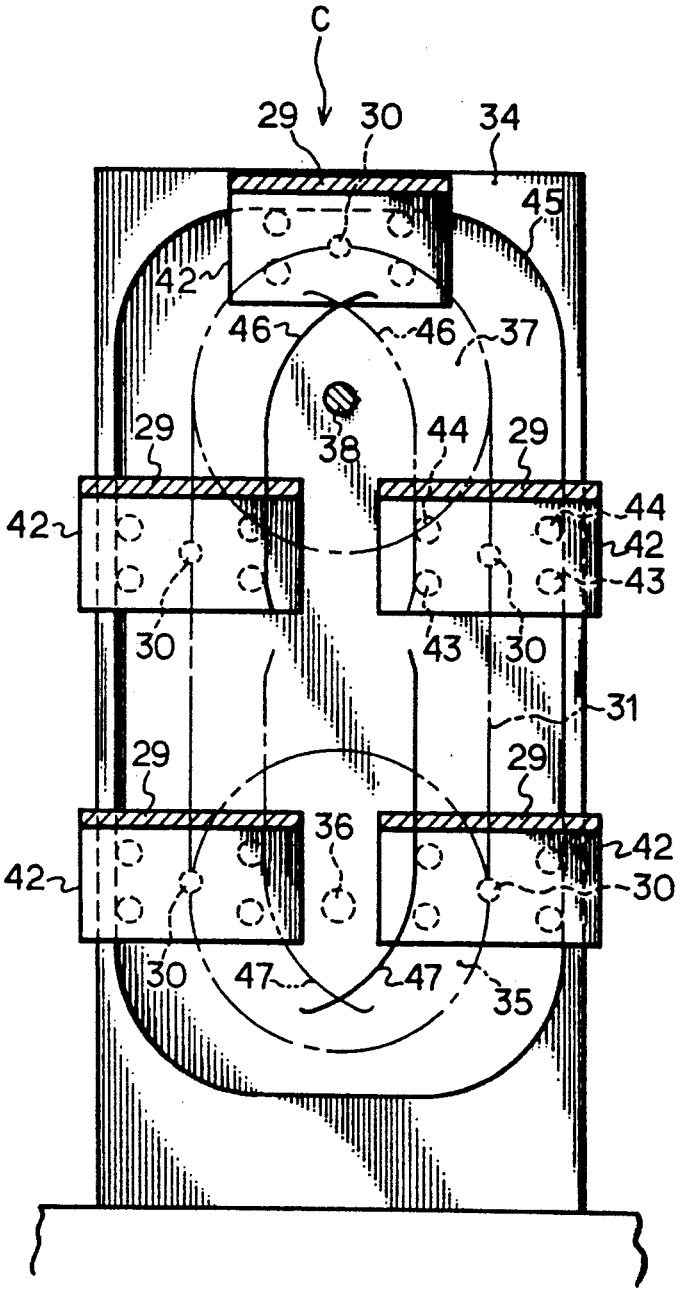
FIG. 3 is a front elevation taken in a longitudinal section along line 3—3 of FIGS. 2 and 4.

Next, the panel group storage mechanism C is composed, as shown in FIGS. 1, 2 and 3, of: shelves 27, 27, 27, 27 and 27 arrayed for supporting a plurality of, e.g., five (in the shown embodiment) panel groups 11; and drive means for moving the shelves sequentially to a predetermined transfer position, i.e., the highest position of the storage mechanism C in the shown embodiment.

The five shelves 27, 27, 27, 27 and 27 supporting the panel groups 11 individually are fixed at an inclination on beds 28, 28, 28, 28 and 28 having an inclination substantially equal to that of the guide slope 12 of the aforementioned panel storage unit. Moreover, all the inclined beds are fixed on horizontal plates 29, 29, 29, 29 and 29. From the two end faces of the horizontal plates, still moreover, there are projected outward arms 30 and 30 which have their free ends connected to endless chains 31 and 31 so that the aforementioned individual shelves are moved as the chains run.

To the upper face of each shelf, moreover, there is attached a removable pallet 32 (as shown in FIG. 4), which has low walls (although not shown) erected from its four sides. The panel group 11 is placed in the pallet 32 thus constructed.

The drive means is for transferring each of the shelves 27 sequentially to the highest transfer position. More specifically, as shown in FIGS. 1, 2 and 3, there are juxtaposed machine frames 33 and 34 which enclose the aforementioned paired endless chains 31 and 31 respectively. On these machine frames, there are borne the individual shafts 36 and 36 of lower sprockets 35 and 35 for supporting the lower portions of the aforementioned endless chains 31 and 31 rotatably. Between the upper portions of those machine frames, there are extended and borne the common shaft 38 of upper sprockets 37 and 37 for supporting the upper portions of the aforementioned endless chains 31 and 31 rotatably. Moreover, one (as seen at the righthand side of FIG. 2) of the paired shafts 36 and 36 is projected out of the machine frame 34 to have its end fixed to a bevel gear 39. Another bevel gear 40 meshes with the former gear 39 and has its shaft driven by a motor 41. As a result, the output of the motor 41 is transmitted through the paired bevel gears 40 and 39 to the shaft 36 and further through the lower sprocket 35 pairing the shaft 36 from one endless belt 31 to the upper sprocket 37. The output is further transmitted through the common shaft 38 to the other upper sprocket 37 and to the other endless belt 31 engaging with the sprocket 37. Thus, the horizontal plates 29, the inclined beds 28 and the shelves 27 are individually moved in a following manner through the two endless belts 31 and 31 and the individual arms 30 connected to the former.

The individual horizontal plates 29 supporting the aforementioned individual shelves 27 are required to maintain horizontal positions at all times. These horizontal positions of the individual horizontal plates 29 are maintained by horizontal position maintaining means which is constructed, as shown in FIG. 3, by interposing a vertical plate 42 between each of the horizontal plates 29 and each of the arms 30 and by projecting two guide rollers 43 and 44 from each of the vertical plates. As a result, totally four guide rollers are projected from the one and other paired vertical plates 42 and 42 through the common horizontal plate 29 and are arrayed in both horizontal and vertical directions. Moreover, these guide rollers 43 and 44 are guided by guide cams 45, 46 and 47 which are disposed in the machine frame 33 and 34, respectively, so that the horizontal positions of the aforementioned horizontal plates 29 are always maintained.

Figure 5:
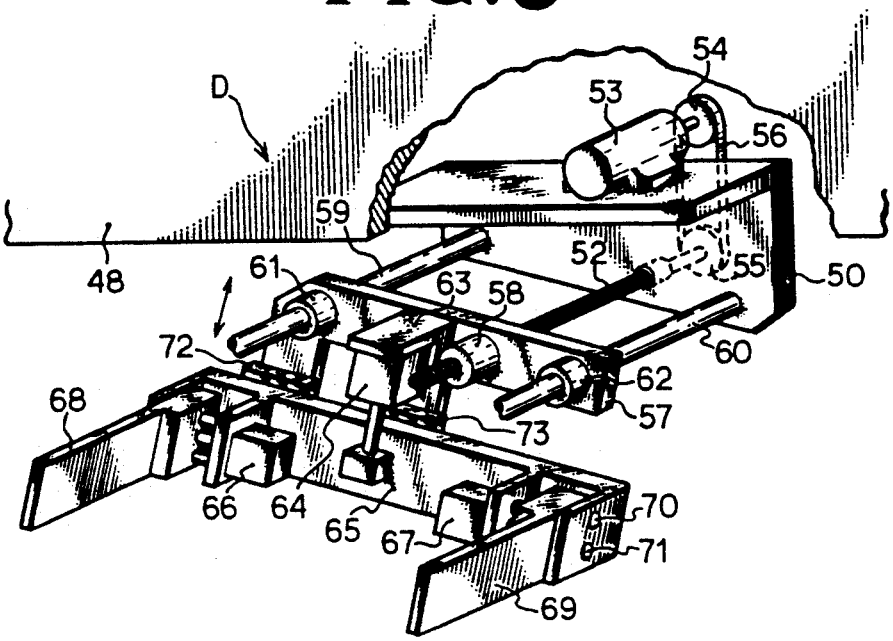
FIG. 5 is a perspective view showing the top of FIGS. 1, 2 and 4.

The transfer mechanism D is constructed, as shown in FIG. 1, by projecting subframes 50 and 51 from a pair of machine frames 48 and 49 of the stacker/bundler A, by bearing the two end portions of an externally threaded rod 52 rotatably between the subframes 50 and 51, by attaching a sprocket 54 to the output shaft of a motor 53 fixed on the subframe 50, by attaching a sprocket 55 to the end of the aforementioned externally threaded rod 52, by connecting those sprockets through an endless chain 56, and by screwing an internally threaded portion 58 of a slider 57 on an intermediate portion of the aforementioned externally threaded rod 52. In order to give a predetermined inclination to the slider 57 and to prevent the rotation of the same, as shown in FIGS. 5 and 6, there are projected from the aforementioned subframe 50 a pair of support rods 59 and 60, which are borne by sliding portions 61 and 62 of the slider 57. From the central portion of this slider 57, moreover, there is projected a bracket 63 having a lower face, on which is mounted a hydraulic cylinder 64 for vertical motions. To the leading end of the rod of the hydraulic cylinder 64, there is fixed a base 65 which has its two ends supporting hydraulic cylinders 66 and 67 for a clamping operation. Hands 68 and 69 are fixed at their roots to the leading ends of those rods. Incidentally, the base 65 is so guided by vertical guide members 72 and 73 as to move vertically in parallel with the rod of the hydraulic cylinder 64. Moreover the hands 68 and 69 have their individual roots guided to slide to the right and left by rightward/leftward guide rods 70 and 71.

The operations of the panel storage feeder according to the present invention will be described in the following.

With first reference to FIG. 6, the signatures are delivered into the (not-shown) stacker/bundler which is disposed below the guide slope 12. If the stacking operation of the signature is started, the pawl plate 14 moves down at a suitable timing to deliver the panels P downward from the exit port 17. The pawl plate 14 thus having ended its delivery restores its initial position.

Between the pawl plate 14 having restored its initial position and a subsequent panel, however, there is left a gap corresponding to the thickness of the panel P which has been delivered forward by the lower end of the pawl plate 14. If the gap were left as it is, the panel would not be delivered out of the exit port 17 by the subsequent delivering action. In order to eliminate that gap, therefore, the paired endless belts 16 and 16 are made to run clockwise downward the inclination of the guide slope 12, as shown, by the not-shown drive means in response to an actuation signal of the pawl plate 14. As a result, the panel groups 11 juxtaposed on those belts are also individually moved in the same direction so that the aforementioned gap disappears to allow the subsequent panel to come into close contact with the pawl plate. When a set time elapses after the lower end of the panel has come to the exit port 17, the drive of the aforementioned belts is interrupted.

During this belt drive, the hold member 15 at the rear end of the panel group 11 is also required to follow the aforementioned movement and come into close contact with the rear end of the displaced panel group 11. Since, at this time, the engagement of the clutch 21 is released, the ribbon 26 can be let off from the reel 25 so that the hold member 15 is enabled to move over the belts 16 and 16 downward on the inclination by the actions of the rollers 18 and 18, thus marking the aforementioned following movement possible.

Figure 7:
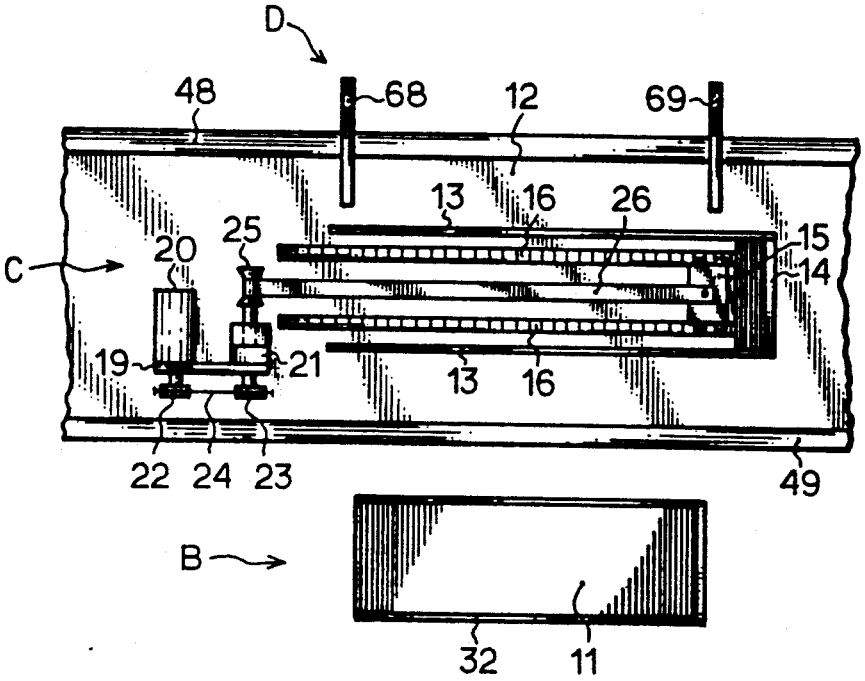

As the panels P are sequentially moved down by the action of the pawl plate 14, as shown in FIG. 7, their residual existing in the panel storage unit over the guide slope 12 reaches a predetermined number, e.g., five. Then, the not-shown sensor detects it to issue a signal. In response to this signal, the engagement of the clutch 21 is effected, and the motor 20 is started so that the reel 25 follows to wind up the ribbon 26. In accordance with this, the hold member 15 is pulled up to the most upstream position of the belts 16 and 16. Then, the not-shown sensor detects the pulled-up position to issue the signal. In response to this signal, the drive of the motor 20 is interrupted so that the hold member 15 is stopped in its standby state.

Subsequently, the motor 53 shown in FIG. 5 is started to begin the forward movements of the hands 68 and 69 connected to the slider 57. Before long, the hands 68 and 69 reach the two end faces of the panel group 11 which stand by in the transfer position at the upper end of the panel group storage mechanism C. The not-shown sensor detects that reach to interrupt the drive of the motor 53 and accordingly the forward movements of the hands 68 and 69.

In accordance with the interruption of the forward movements of the hands 68 and 69, the clamping hydraulic cylinders 66 and 67, as shown in FIG. 5, have their rods shortened to reduce the gap between the paired hands 68 and 69 so that the panel group 11 standing by in the transfer position has its end face clamped by the hands 68 and 69 (as shown in FIG. 8).

Since the hands 68 and 69 thus clamping the panel group 11 inbetween is displaced upward by the action of the vertically moving hydraulic cylinder 64, the panel group 11 is also moved upward until it is pulled out of the pallet 32 (as shown in FIG. 8).

Figure 9:
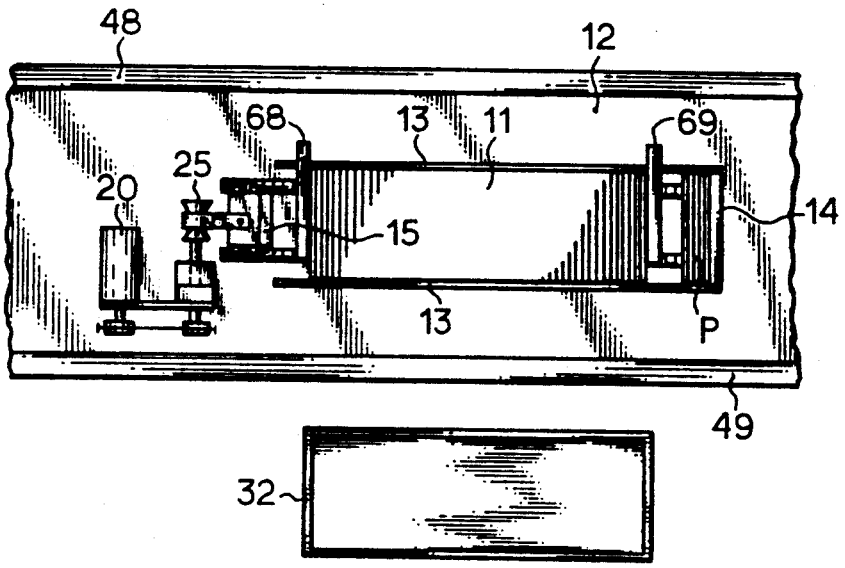
FIG. 9 is a top plan view showing the associated operations of the transfer of a panel group and the feed of the transferred panels and the state immediately before the transfer of the panel group is completed.

Next, the motor 53 shown in FIG. 5 has its backward rotation started to begin the retractions of the hands 68 and 69 connected to the slider 57. Then, the hands 68 and 69 arrive just above the belts 16 and 16 before long. The not-shown sensor detects this arrival to interrupt the drive of the motor 53. Then, the vertically moving hydraulic cylinder 64 is actuated to extend its rod so that the panel group 11 clamped between the hands 68 and 69 is placed between the guide walls 13 and 13 over the guide slope 12 (as shown in FIG. 9).

Moreover, the clamping hydraulic cylinders 66 and 67 are actuated to extend their rods so that the paired hands 68 and 68 have their gap extended to release the panel group 11.

Figure 10:
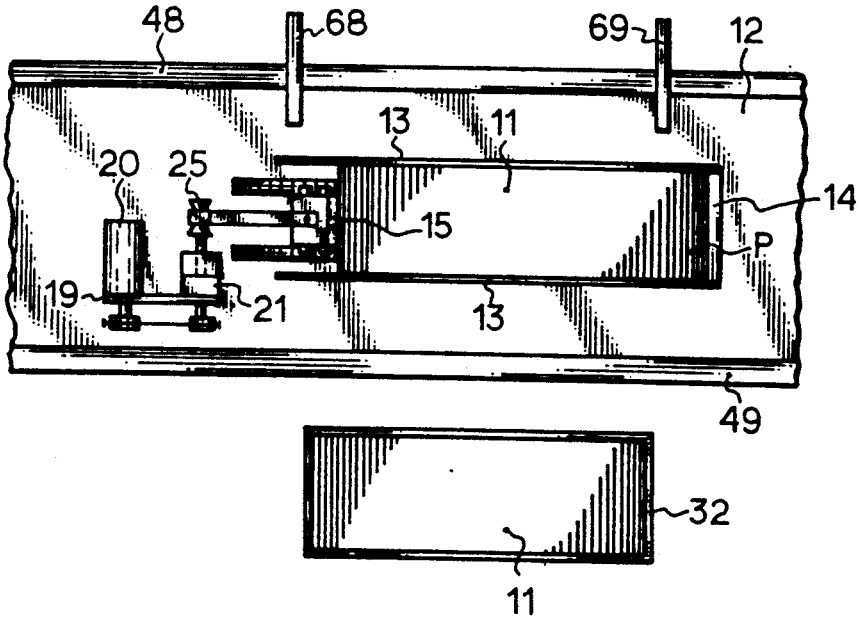
FIG. 10 is a top plan view showing the associated operations of the transfer of a panel group and the feed of the transferred panels and the state after the transfer of the panel group and after the standby of the subsequent panel group.

After this, the motor 53 shown in FIG. 5 has its backward rotation started again to further retract the hands 68 and 69 connected to the slider 57. When the hands 68 and 69 restore their standby positions, the motor 53 has its drive interrupted to come into its standby state (as shown in FIG. 10).

When the hands 68 and 69 leave the panel group 11, the panels of the group 11 have their individual upper ends inclining downward in the inclination of the guide slope 12 to establish gaps at their lower ends. Then, the belts 16 and 16 start their run with the clutch 21 being released. As a result, the lower ends of the individual panels are delivered toward the pawl plate 14, and the hold member 15 is also brought into close contact with the rear end face of the panel group 1 as the ribbon 26 is let off from the reel 25. Thus, the individual panels of the succeeding panel group 11 come into close contact with the remaining previous panels.

On the other hand, the aforementioned panel group storage mechanism is started to move the subsequent panel group 11 to the transfer position so that the panel group 11 is stopped there in the standby state.

In the embodiment thus far described, the running time of the belts 16 and 16 is set to a proper value by the action of a (not-shown) timer.

The operation commands of the individual parts based upon the detection of the individual sensors are controlled by a (not-shown) control unit according to the technology of the prior art.

By the time when all the panel groups 11 are sequentially transferred to their last from the individual shelves 27 of the panel group storage mechanism C onto the panel feed mechanism B, the emptied ones of the shelves have to be supplied with new panel groups. This supply is executed before the panel group transfer mechanism D starts its subsequent operation. Specifically, the supply of new panel groups is accomplished such that the empty pallets 32 are removed from the individual shelves 27, 27 and 27 and replaced by other pallets carrying the new panel groups by the operator. At this time, the individual parts of the storage mechanism C can be manually operated to move the individual shelves sequentially to the panel supply position, as indicated at S in FIG. 1, so that the panel groups 11 can be manually supplied.

The foregoing embodiment should not limit the present invention but be able to cover all the modifications within the scope of the claim of the invention.

In the storage feeder according to the present invention, as has been described in detail hereinbefore, both shelves capable of supporting a plurality of panel groups and a panel group storage mechanism capable of moving the shelves sequentially to a predetermined transfer position are disposed adjacent to the panel feed mechanism well known in the art, so that the panel group standing by on the shelf in the transfer position can be transferred to the panel feed mechanism and can be automatically supplied. As a result, a remarkably large number of panels can be stored in advance for shortage of their supply so that the panel feed can be ensured for a long time. Thus, it is possible to eliminate the troublesome works of confirming the residue of the panels and supplying the panels, which have been frequent in the prior art.

In the panel storage feeder according to the present invention, moreover, the panel groups can be supplied by their storage mechanism, which is apart from the moving space of the stacker/bundler, so that their supply can be executed safely and promptly.

What is claimed is:

1. A panel storage feeder comprising:

a panel feed mechanism disposed over a signature piling space and including a panel storage unit for storing a multiplicity of panels, and panel delivery means for delivering the panels sequentially one by one in a predetermined position from said storage unit toward said signature piling space;

a panel group storage mechanism disposed at a side of said signature piling space and including the upper portion thereof provided at a level substantially equal to that of said panel feeding mechanism, shelves arrayed to support a plurality of panel groups each composed of a multiplicity of panels, and drive means for transferring said shelves sequentially to said upper portion of the panel group storage mechanism;

a panel group transfer mechanism for transferring the panel group, which stands by on the shelf in said upper portion of the panel group storage mechanism, to said panel storage unit of the panel feeding mechanism;

said panel storage unit including a guide slope, guide walls having gaps adjusted for regulating two side faces of said panel group, a pawl plate for supporting a front end face of said panel group, and a hold member for supporting a rear end face of said panel group; and said shelves being substantially fixed at an inclination on beds having an inclination substantially equal to that of a guide slope of said panel storage unit, said inclined beds being fixed on horizontal plates respectively, arms being projected outward from both ends of said horizontal plates, a pair of endless chains being respectively connected to free ends of said horizontal plates, and two pair of lower and higher sprockets for supporting the pair of endless chains respectively.

2. A panel storage feeder according to claim 1, wherein the horizontal plates are respectively maintained by horizontal position maintaining means which is constructed by interposing a vertical plate between each of the horizontal plates and each of the arms, and by projecting two pairs of lower and higher guide rollers from each of the vertical plates, and said guide rollers being respectively guided by outer and inner cams which are disposed along a frame.

* * * * *